US005534343A

United States Patent [19]

Landi et al.

[11] Patent Number: 5,534,343

[45] Date of Patent: Jul. 9, 1996

[54] FLEXIBLE BALLISTIC RESISTANT ARTICLE HAVING A THERMOPLASTIC ELASTOMERIC HONEYCOMB PANEL

[75] Inventors: Curtis L. Landi; Susan L. Wilson, both of Sunnyvale; Michael S. Huber, Campbell, all of Calif.

[73] Assignee: Supracor Systems, Inc., Sunnyvale, Calif.

[21] Appl. No.: 275,771

[22] Filed: Jul. 15, 1994

[51] Int. Cl.[6] ..... F41H 5/02; B32B 3/04; B32B 3/21

[52] U.S. Cl. ..... 428/313.5; 428/911; 2/2.5; 89/36.02

[58] Field of Search ..... 2/2.5; 428/911, 428/313.5; 89/36.02

[56] References Cited

U.S. PATENT DOCUMENTS

| | | | |
|---|---|---|---|
| 2,771,384 | 11/1956 | Collins | 154/52.5 |
| 3,337,875 | 8/1967 | Blakeney | 2/2.5 |
| 3,577,836 | 5/1971 | Tamura | 2/2.5 |
| 3,829,899 | 8/1974 | Davis . | |
| 3,894,472 | 7/1975 | Davis . | |
| 3,971,072 | 7/1976 | Armellino . | |
| 4,004,493 | 1/1977 | Costanza . | |
| 4,125,053 | 11/1978 | Lasker | 89/36 |
| 4,413,357 | 11/1983 | Sacks . | |
| 4,422,183 | 12/1983 | Landi et al. . | |
| 4,660,223 | 4/1987 | Fritch . | |
| 4,681,792 | 7/1987 | Harpell et al. . | |
| 5,087,516 | 2/1992 | Groves . | |
| 5,124,195 | 6/1992 | Harpell et al. . | |
| 5,187,023 | 2/1993 | Prevorsek et al. . | |
| 5,196,252 | 3/1993 | Harpell . | |
| 5,254,383 | 10/1993 | Harpell et al. . | |
| 5,317,950 | 6/1994 | Binon et al. | 2/2.5 |
| 5,349,893 | 9/1994 | Dunn | 89/36.02 |

FOREIGN PATENT DOCUMENTS

| | | |
|---|---|---|
| 2504849 | 6/1975 | Germany . |
| 2614892 | 6/1976 | Germany . |

*Primary Examiner*—Newton Edwards
*Assistant Examiner*—Richard C. Weisberger
*Attorney, Agent, or Firm*—Claude A. S. Hamrick

[57] ABSTRACT

A flexible ballistic resistant article for protecting a user from a high speed projectile, including an outer layer for stopping the forward motion of the projectile, and an inner layer disposed between the outer layer and the user. The inner layer reduces the backface signature of the outer layer thereby reducing the blunt trauma experienced by the user. The outer layer including a plurality of plies of high tensile strength fibers. The inner layer including a honeycomb core formed of undulated strips of resilient thermoplastic material, thermal compression bonded together to form cell walls defining a plurality of contiguous regularly shaped cells. The core having a first face formed by a first extremity of the cell walls, and a second face formed by a second extremity of the cell walls. The core further having means for maintaining the core in its expanded configuration so that it can be used to anisotropically flex to stabilize and spread the load experienced by the user. The maintaining means being a facing sheet attached to one of the first and the second faces of the core. A cover for encasing each of the inner and the outer layers. Means for attaching the cover to the user.

12 Claims, 7 Drawing Sheets

FLEXIBLE BALLISTIC RESISTANT ARTICLE HAVING A THERMOPLASTIC ELASTOMERIC HONEYCOMB PANEL

BACKGROUND TO THE INVENTION

1. Field of the Invention

The invention relates to a flexible ballistic resistant article of the type which can be worn to protect the wearer from a high speed projectile such as a bullet fired from a handgun or a rifle. More particularly, the present invention relates to an improved flexible ballistic resistant article having a thermoplastic elastomeric honeycomb panel disposed therein.

2. Description of the Prior Art

Personal use ballistic resistant shields, e.g., body armor, having a rigid construction are known. For example, in a common type of shield, the material used in an outer bullet-trapping layer essentially includes an array of metallic plates joined by tough flexible cloth to provide a wearable garment. These shields can provide effective protection but are uncomfortable to wear because of their bulk, weight, stiffness, and lack of breathability. Illustrative of bullet-proof shields having metallic plates or sheets disposed within are described in U.S. Pat. Nos. 5,187,023, 4,660,223, 4,004,493, 3,971,072, 3,894,472 and 3,829,899.

Also known are ballistic resistant shields which include high tensile strength penetration-resistant fabrics that are somewhat flexible. Fibers used in such articles include aramid fibers, graphite fibers, nylon fibers, ceramic fibers, polyethylene fibers, glass fibers and the like. For many applications, such as vests or parts of vests, the fibers are used in a woven or knitted fabric, and encapsulated or embedded in a matrix material. However, in body shields made from materials such as these, it is difficult to limit the risk of serious injury to the user while at the same time designing a shield having low weight, reduced bulk and appreciable flexibility. This is because the fibers of the penetration-resistant fabric stretch as they absorb a bullet's energy thereby creating a bulge at a back surface of the shield, i.e. a surface opposite the surface of the shield impacted by the bullet. The bulge at the back surface can transmit an appreciable shock to an adjacent region of the user's body. The bulge at the back surface of the shield, is referred to as the "backface signature", and the transmitted shock is called the "blunt trauma" experienced by the shield user.

U.S. Pat. No. 4,413,357 discloses a protective shield having an outer penetration-resisting layer comprised of at least eight and preferably twenty-eight individual superposed plies of close woven fabric of aramid fibers, an intermediate impact-spreading layer comprised of at least one ply of thin flexible impervious plastic sheet such as polycarbonate, and an inner or impact-cushioning layer formed from relatively soft and thick foam plastic that absorbs the impact and bullet bulge of the polycarbonate sheet.

U.S. Pat. No. 5,087,516 discloses body armor having an outer component and an inner component. The outer component, flattens and traps a striking bullet, while the inner component spreads the impact of the bullet. The outer component includes a pair of layers of flexible material at least the inner layer of which is high impact-resistant material having at least two juxtaposed inter-nested layers of hard glass beads between the flexible layers, each layer of glass beads being arranged in a close packed lattice pattern.

U.S. Pat. No. 5,196,252 discloses a ballistic resistant body armor comprising a substrate layer having a plurality of planar, non-metallic bodies mechanically affixed to a surface thereof.

A disadvantage associated with each of the articles disclosed is that a critical component of each is a relatively rigid plate or item, e.g. polycarbonate sheet, non-metallic bodies, or glass beads, thereby rendering the entire ballistic shield stiff, inflexible, heavy and generally uncomfortable to use.

U.S. Pat. No. 4,422,183 discloses a protective body shield including a honeycomb core arranged with the axis of each cell of the honeycomb panel aligned perpendicular to the body surface of the wearer. A layer of resilient foam covers at least the one side of the shield that is in contact with the body to produce a shield that is rigid and shock absorbing in the direction of anticipated impacts, but flexible and yieldable in other directions so as not to interfere with the movement of the wearer's body. It is clear from the disclosure that the protective body shield is not made from ballistic resistant materials and therefore unsuitable for use as a ballistic resistant article.

Thus, there is a need for a ballistic resistant article that overcomes the deficiencies of the prior art devices.

SUMMARY OF THE INVENTION

Objects of this Invention

It is an object of the present invention to provide an improved flexible ballistic resistant article.

It is another object of the present invention to provide an improved flexible ballistic resistant article having flexible fibers and a thermoplastic elastomeric honeycomb panel.

It is another object of the present invention to provide an improved flexible ballistic resistant article having a reduced backface signature, as compared to other non-metallic ballistic resistant articles, thereby reducing the amount of blunt trauma experienced by a user of the article.

It is yet another object of the present invention to provide an improved flexible ballistic resistant article that is light in weight.

It is still another object of the present invention to provide an improved flexible ballistic resistant article that is flexible and somewhat breathable, and generally comfortable to wear.

Briefly, a flexible ballistic resistant article for protecting a user from a high speed projectile, includes an outer layer for stopping the forward motion of the projectile, and an inner layer disposed between the outer layer and the user. The inner layer reduces the backface signature of the outer layer thereby reducing the blunt trauma experienced by the user. The outer layer including at least one ply of high tensile strength fibers. The inner layer including a honeycomb core formed of undulated strips of resilient thermoplastic material, thermal compression bonded together to form cell walls defining a plurality of contiguous regularly shaped cells. The core having a first face formed by a first extremity of the cell walls, and a second face formed by a second extremity of the cell walls. The core further having means for maintaining the core in its expanded configuration so that it can be used to anisotropically flex to stabilize and spread the load experienced by the user. A cover for encasing each of the inner and the outer layers. Means for attaching the cover to the user.

An advantage of the present invention is that it provides a ballistic resistant article that reduces the backface signature of the projectile stopping substrate layer.

Another advantage of the present invention is that it provides a ballistic resistant article that reduces the blunt trauma experienced by a user of the article.

Another advantage of the present invention is that it provides a ballistic resistant article that is constructed from materials having improved flexibility and shock absorption capability.

Still another advantage of the present invention is that it provides a ballistic resistant article that is lightweight and comfortable to wear.

Another advantage of the present invention is that since the projectile stopping substrate is used to stop the projectile and not to reduce the backface signature the number of plies of the projectile stopping substrate can be reduced.

These and other objects and advantages of the present invention will no doubt become apparent to those skilled in the art after having read the following detailed description of the preferred embodiment which is contained in and illustrated by the various drawing figures.

DETAILED DESCRIPTION OF THE PREFERRED EMBODIMENT

Figure 1:
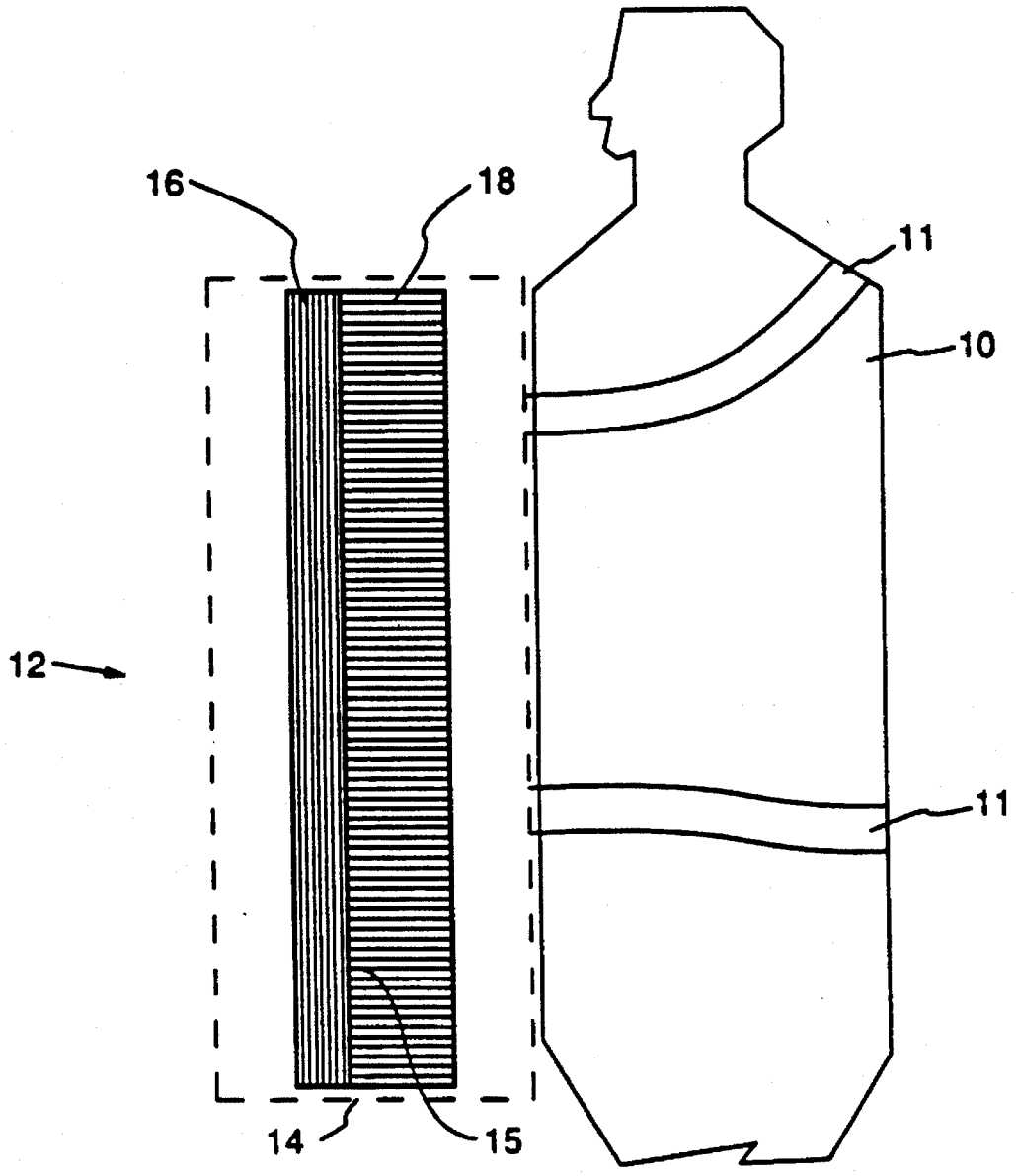
FIG. 1 is a side view schematically depicting the inner components of one embodiment of the present invention attached to a user.

FIG. 1 is a side view schematically illustrating a ballistic-resistant article 12 worn by a user 10. It should be noted that although an article 12 in the form of a vest is schematically depicted, other articles are contemplated by the embodiments of the present invention. For example, helmet liners, screens, back and side body shields, etc. can be fabricated using the embodiments of the present invention. It should further be noted the article 12 is attached to the user 10 by attaching means 11 that are known in the art, e.g. straps, belts, etc.

The article 12 includes a cover or casing 14 which encases an outer layer 16 and an inner layer 18. The casing 14 is made from readily available fabric materials that are preferably permeable. The casing 14 is shown in dashed lines in order to more clearly illustrate the layers 16 and 18 of the article 12. The inner layer 18 is disposed adjacent to and between each of the user 10 and the outer substrate 16. The inner layer 18 may be attached, via adhesive or thermal bonding, to the outer layer 16. Alternately, the layers 16 and 18 may be disposed proximate each other but unattached to each other.

The outer layer 16 initially engages a high speed projectile (i.e. a bullet) and stops its forward motion. The layer 16 includes at least one ply having a plurality of high tensile strength fibers arranged in either a unidirectional or a woven configuration. It will be appreciated that a variety of materials, ply and fiber arrangements may be used to construct the layer 16.

In the specimens tested in the setup illustrated in FIG. 8 and, described in greater detail below, the layer 16 includes at least one layer of Spectra® Shield material (FIG. 1), and several plies of Spectra® Fabric material (FIG. 1).

Spectra® Fabric material is interwoven from high tensile strength fibers, designated by the trademark Spectra®, which are made from ultra-high weight polyethylene molecules modified by a special process patented by Allied-Signal. The Spectra® fibers can be woven in a variety of weaves depending on the particular application. Typically in a ballistics application, a very tight weave would be used.

Spectra® Shield material is another type of fabric having a plurality of woven high tensile strength fibers. Because of the warp and weave interlacing created by the weaving process, the woven fibers (of, for example, a Spectra® Fabric material) do not immediately go taught when the fabric is struck by a bullet. This can be undesirable, as a primary reason to use Spectra® fiber (or any other high tensile strength fiber) in a ballistic resistant article is to take advantage of the enormous tensile strength of the fiber which is typically ten times stronger than steel on a weight basis. Consequently, a Spectra® Shield layer is made up of two unidirectional sublayers of Spectra® fibers held in place with flexible resins, which is sealed between two thin sheets of polyethylene film. The result is a thin, flexible material which, when impacted by a high velocity projectile, efficiently loads the high tensile strength fibers.

Although Spectra® fibers have been used in the tested specimens, the preferred embodiment of the present invention can use other types of similar high tensile strength fibers. For example, high tensile strength fibers made from other materials, e.g. Kevlar®, may be used to fabricate the outer layer 16. Also, although an outer layer 16 including Spectra® Shield and Spectra® Fabric materials has been described, it will be appreciated that alternate material combinations may be used.

The inner layer 18 absorbs energy remaining in the projectile after its forward motion is stopped by the outer layer 16. The inner layer 18 controls the amount of force transmitted to the user 10 by reducing the backface signature of the back face 15 of the outer layer 18 and by mitigating the blunt trauma experienced by the user 10.

Figure 2:
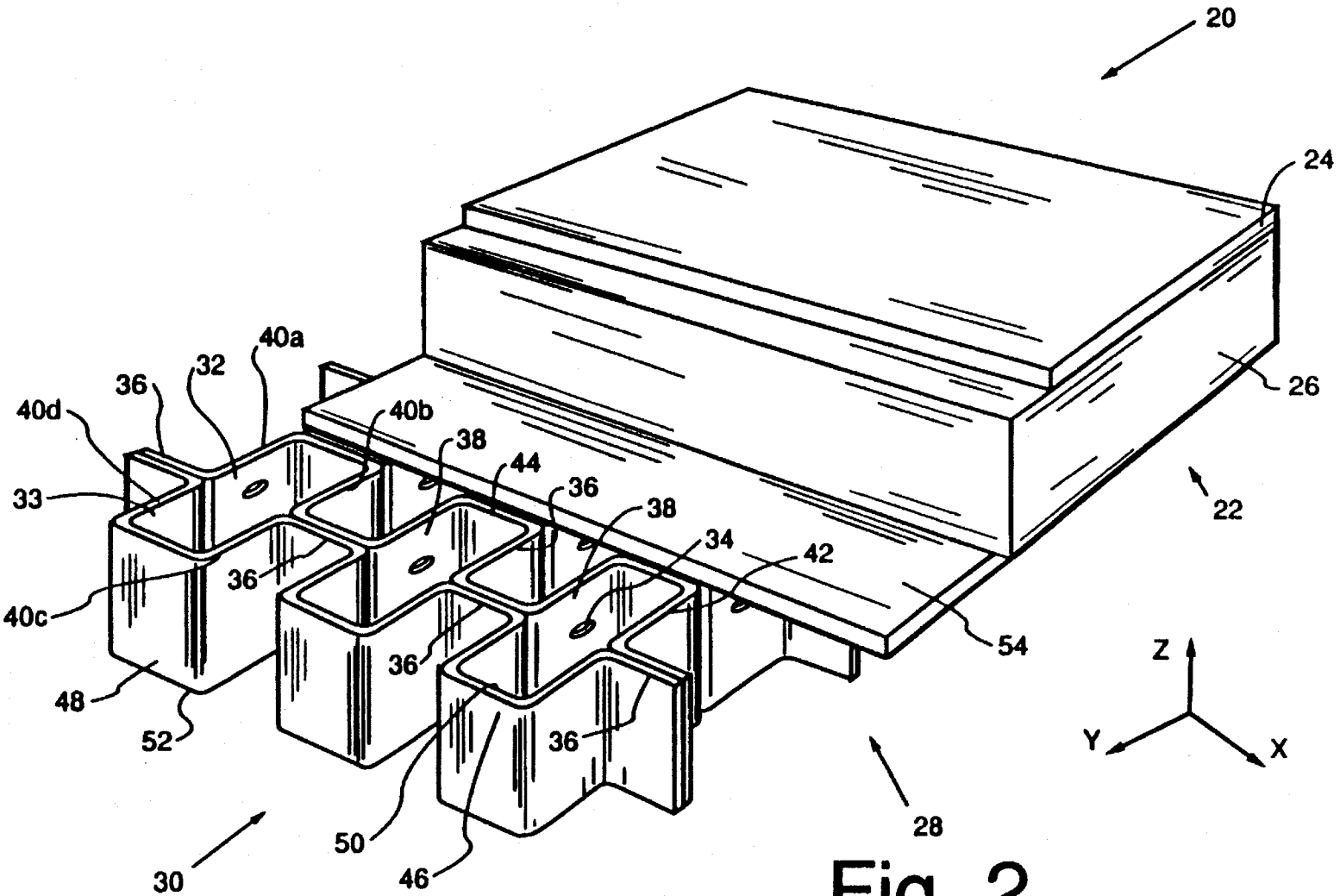
FIG. 2 is a perspective view showing a preferred embodiment of the present invention having succeeding layers of material removed to reveal a flexible thermoplastic elastomeric honeycomb panel.

FIG. 2 is a perspective view of a preferred embodiment of the present invention. A ballistic resistant article 20, generally similar to the article 12 (FIG. 1) is depicted with its casing omitted for clarity purposes. An outer layer 22 includes a Spectra Shield® material layer 24 and a Spectra® Fabric material layer 26. The material layers 24, and 26 have been cut back to reveal the inner layer 28. The layer 28 includes a honeycomb core 30 which is initially made from a stack of strips or ribbons 32 and 33 of a selected grade of thermoplastic elastomeric material. In the preferred embodiment the ribbons are not perforated, as shown by ribbon 33. However, it will be appreciated that, in alternate embodiments some or perhaps all of the ribbons may be perforated such that a matrix of small holes 34 exists throughout, as illustrated by ribbon 32. The ribbons 32 and 33 are thermal compression bonded together at spaced intervals staggered between alternate strips, as depicted at bond joints 36. When the bonded stack is expanded, this pattern of bonding results in a honeycomb of generally hexagonally or rectangularly shaped cells 38 (depending on the degree of expansion). The core 30 manufacturing and fabrication is described in greater detail in U.S. Pat. No. 5,039,567 which is incorporated herein by reference.

Each cell 38 of the honeycomb core 30 is defined by four generally S-shaped wall segments 40*a–d*, each of which is shared by an adjacent cell. As depicted, each wall segment 40(*a–d*) of each cell 38 includes a single thickness wall portion 42 and a double thickness wall portion 44 (including the bond joint 36).

Each wall segment 40 has an outer extremity 46 and an inner extremity 48. The core 30 has an outer "face" 50 and an inner "face" 52 either or both of which may be deformed during a planarization operation, as disclosed in the above-identified U.S. Pat. No. 5,039,567, to form a means for maintaining the core 30 in its expanded configuration and preventing the expanded strip stack from collapsing. The inner face 52 is formed proximate to the inner extremity 48, the outer face 50 is formed proximate to the outer extremity 46.

A facing sheet 54 is thermal compression bonded to the outer face 50 formed by the outer extremity 46 of each wall segment 40(*a–d*). Typically, the facing sheet 54 would be made from the same material as the core 30, and can be either perforated or solid. The facing sheet 54 when supported by the outer extremity 46 of each wall segment 40 has a "trampoline" effect that mitigates backface signatures of portions of the outer layer 22 that impinge into the open areas of a cell. That is, the facing sheet 54 covers an open area of each cell and limits the encroachment of a deformed layer 22 into these open areas.

Although the casing 14 (FIG. 1) separates the inner face 52 of the core 30 from the skin of the user, the magnitude of the projectile velocity is sufficient to imprint a non-planarized sharp edged inner face 52 onto the skin of the user. Thus, it is preferable to planarize the inner face in order to mitigate this "cookie cutter effect."

An important aspect of the present invention is using a flexible thermoplastic elastomeric honeycomb panel with the outer layer having a plurality of plies of high tensile strength fibers. A honeycomb panel absorbs the energy remaining after the high tensile strength fibers of the outer layer stop the projectile. The use of a honeycomb panel of the present invention permits fewer plies of ballistic material (i.e. high tensile strength fiber) to be used in the outer layer to achieve the same results as shields in the prior art. Thus, shields using a honeycomb panel of the present invention will be generally lighter, more flexible and more comfortable to wear without reducing the shield's bullet stopping and blunt trauma mitigating capability.

The honeycomb core 30 is tear-resistant, highly resilient, yet extremely light weight. The core 30 (without facing sheets) is approximately 90 percent air, and is lighter than the foams normally used in prior art ballistic resistant articles.

Another important quality of the core 30 is that it is an anisotropic three-dimensional structure which has varying degrees of flex in its width (X), length (Y), and its thickness (Z) dimensions.

Selected combinations of elastomer material and modulus, honeycomb cell configuration, and core thickness variables will determine the core's 30 softness or hardness, damping characteristics, and rigidity or flex as required for a particular application. Additionally, by selection and combination of the ribbons 32, 33 of material that make up the core 30, or by varying the core 30 dimensions and cell 38 sizes, the flexibility of the resulting core 30 can be predetermined. For example, the core 30 can be made to have a greater stiffness (and lesser flexibility) along the outer area and a lesser stiffness (and greater flexibility) toward the inner area of the panel or vice-a-versa.

The facing and ribbon materials can be selected from a wide variety of films, including blends such as urethane/polycarbonates, spun-bonded thermoplastics such as polyethylene or polypropylene polyester, thermoplastic urethanes, elastomeric or rubber materials, elastomer impregnated fibers and various fabrics, etc., or combinations thereof.

Figure 3:
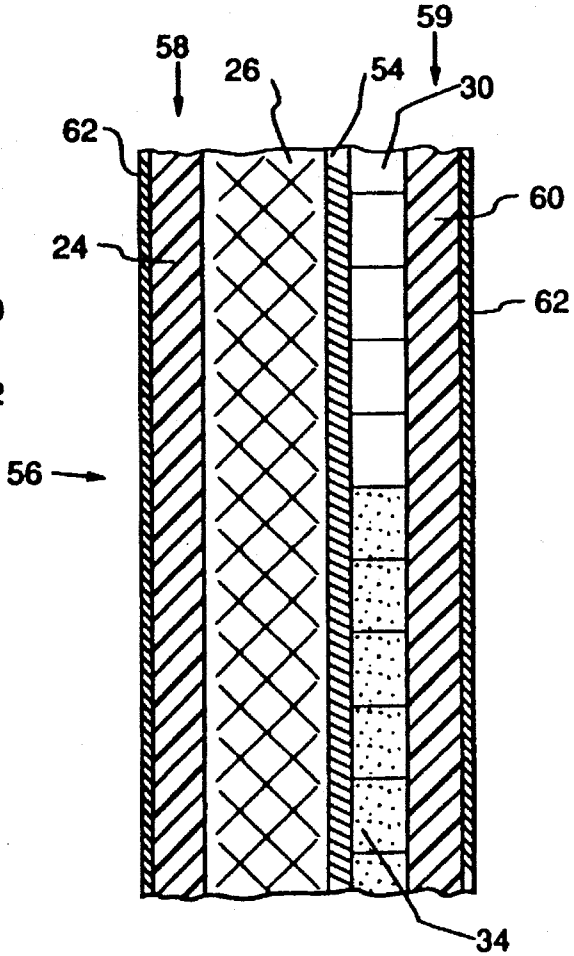
FIG. 3 is a cross sectional view, illustrating another alternate embodiment of the present invention.

FIG. 3 illustrates another embodiment of the present invention. A ballistic resistant article 56 includes an outer layer 58, an inner layer 59, and an inner material layer 60. All the layers 58, 59, 60 are encased within a permeable fabric casing 62. The casings 60 and 14 (FIG. 1), the layers 58 and 22 (FIG. 2), and the layers 59 and 28 (FIG. 2) are generally similar. It will be appreciated that the core 30 of the layer 59 could have perforations 34 formed in some or all of the cell walls, as illustrated at the bottom half of the figure. Alternately, none of the cell walls could be formed with perforations. As with the article 20 (FIG. 2), the facing sheet 54 may be either solid or perforated, and fabricated from a gauge of resilient thermoplastic material that is generally similar to the material used in the ribbons of the core 30. The facing sheet 54 may be thermal compression bonded to either the outer face of the core 30, as illustrated, or bonded to the inner face of the core 30.

The inner material layer 60 is made from a woven high tensile strength fabrics (e.g. Spectra® Shield), and disposed between the user and the core 30. The material layers 24 and 26 are typically bonded to each other, although they need not be. Similarly, the face sheet 54 may be bonded to the material layer 26, and the core 30 may be bonded to the material layer 60, although it is not required.

Figure 4:
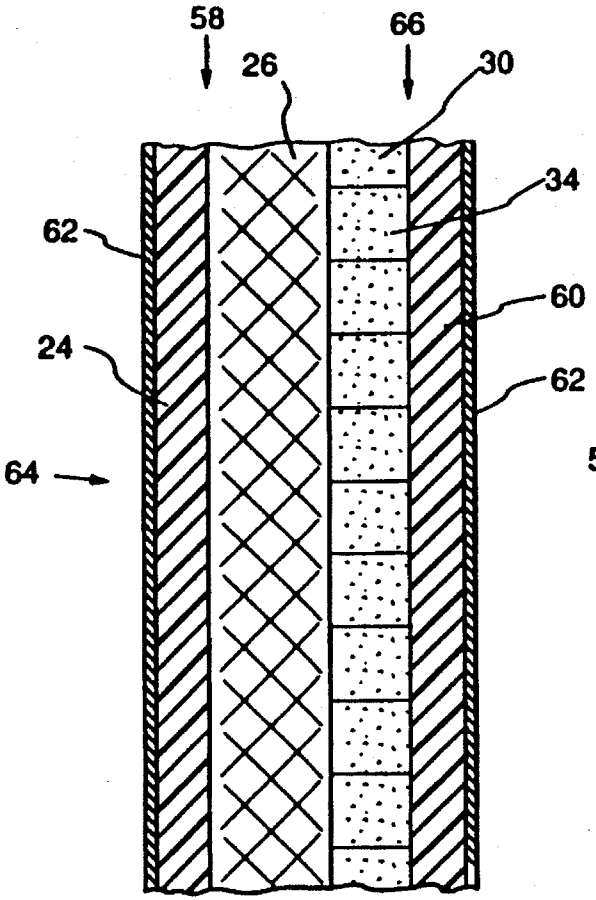
FIG. 4 is a cross sectional view, illustrating yet another alternate embodiment of the present invention.

FIG. 4 illustrates another alternate embodiment of the present invention. A ballistic resistant article 64 having an outer layer 58, an inner layer 66, and an inner material layer 60 encased within a permeable casing 60. The article 64 is generally similar to the article 56 (FIG. 3) except that the inner layer 66 does not include a facing sheet. The inner layer 66 includes the flexible thermoplastic elastomeric core 30 which is bare or unfaced and further having perforations 34 formed in the cell walls thereof.

Figure 5:
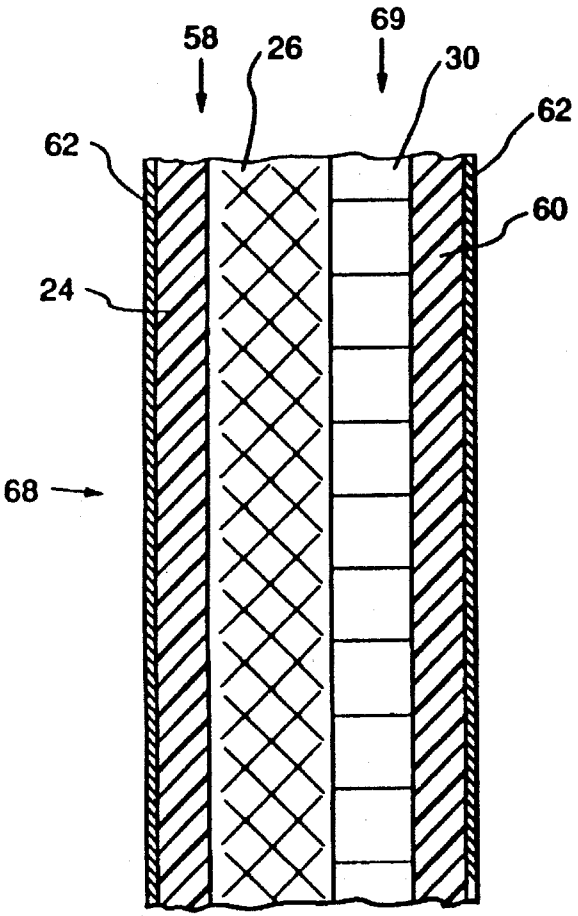
FIG. 5 is a cross sectional view, depicting still another alternate embodiment of the present invention.

FIG. 5 illustrates yet another alternate embodiment of the present invention. In this embodiment, a ballistic resistant article 68 includes generally the same elements as the article 64, however the cell walls of the core 30 do not have perforations formed therein.

In the articles 64 and 68, (FIGS. 4, 5) the honeycomb core 30 was not bonded to the material layer 26 or the material layer 60. The honeycomb core 30 is edge-stitched into the fabric casing 62 during the fabrication of the article. Typically the material layers 24 and 26 are bonded together, however, it is not required to have these layers attached.

The perforations formed in the cell walls of an article, (e.g. the article 64, FIG. 4) provide several important benefits. The perforations enhance air flow and moisture transport through the honeycomb cells. This improves the comfort and wearability and the ballistic resistance characteristics of the vest. From a comfort standpoint, movement of the wearer flexes the cells creating an air exchange pumping action through the perforations. Also, the additional air flow provided by these perforations helps to minimize the force contribution of the air trapped in the cells compressed by the backface bulges of the vest when impacted by a projectile.

The ballistics tests for backface signature, to be described in greater detail below, utilized only sample articles having bare faced honeycomb panels, i.e only the ballistics resistant articles 64 and 68 (FIG. 4, 5) were tested. It will be appreciated, however, that the article 56 (FIG. 3) or the article 20 (FIG. 2) could be tested and would yield similar or better ballistic test results regarding backface signature.

Figure 7A:
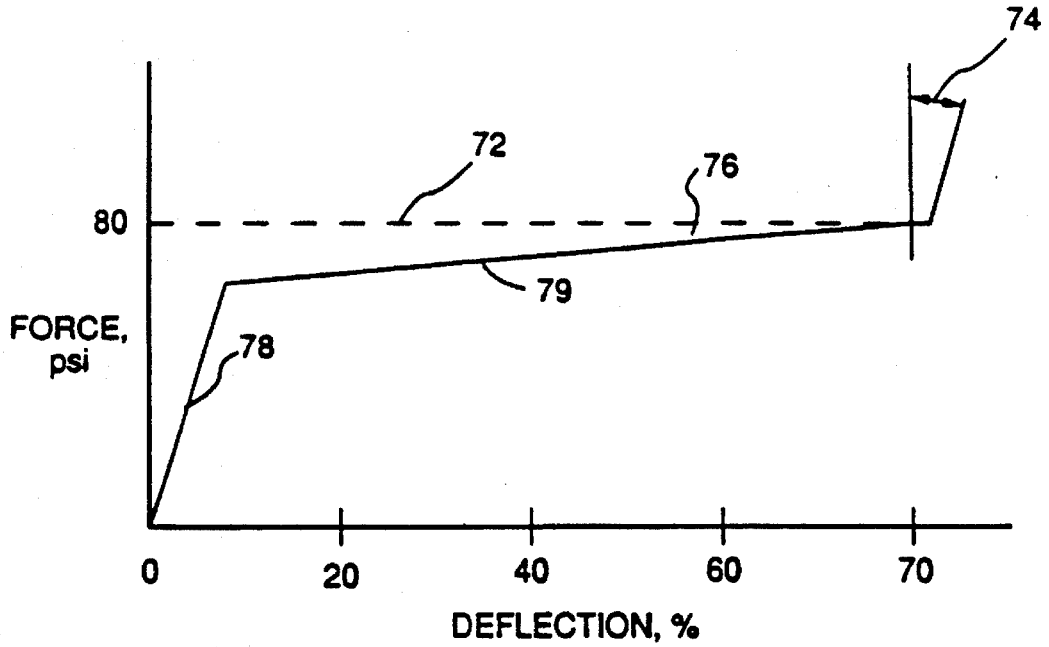
FIG. 7*a* depicts a force-deflection curve of a representative panel of flexible thermoplastic elastomeric honeycomb of the present invention.
Figure 6:
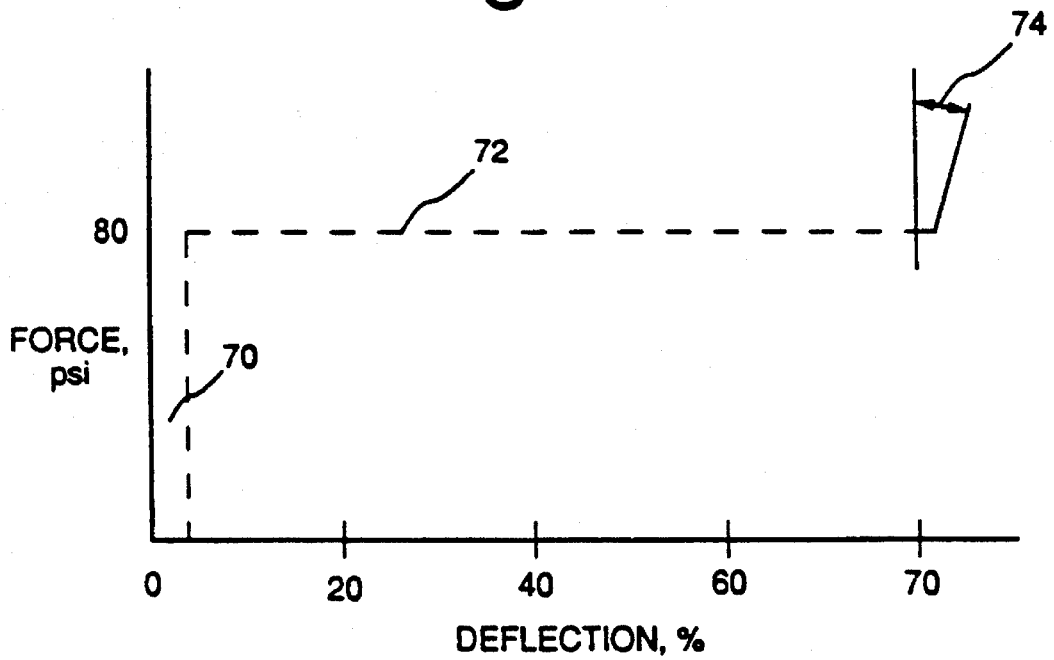
FIG. 6 illustrates an idealized square-wave force-deflection curve.
Figure 7B:
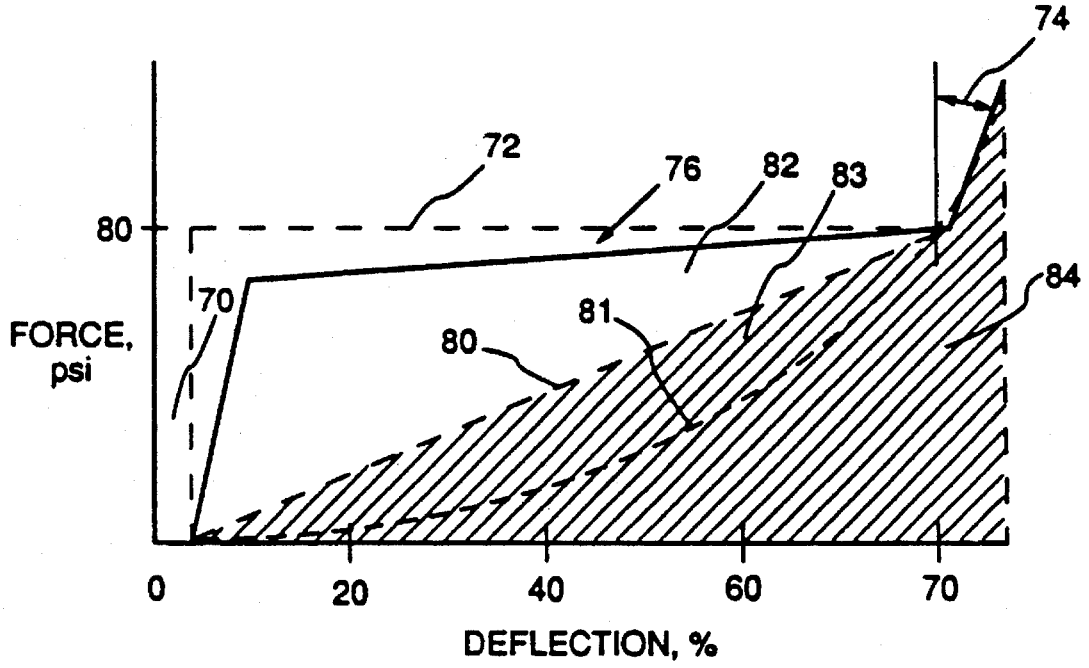
FIG. 7*b* shows several force-deflection curves representing different resistant systems, e.g. a coil spring system, an open-cell foam system, and a system having a flexible thermoplastic elastomeric honeycomb panel.

The flexible, elastomeric honeycomb panel works well in an impact application because it approaches a "ramp-plateau" or "square wave" response. These principals are illustrated in FIGS. 6, 7*a*, and 7*b*.

In designing a ballistic resistant article it is important to identify a reasonable maximum force that can be transmitted to the body of the user, and then design an impact absorbing system that limits the force to this maximum.

For example, if a reasonable maximum force that can be transmitted to a body is assumed to be 80 psi, then the most efficient absorption system would immediately "ramp" up to 80 psi when compressed, or loaded, however the force transmitted to the user's body would not exceed 80 psi until the absorption system "bottomed out". In addition, the absorption system should be designed to absorb the energy before bottoming out. The absorption system "bottoms out" when it is compressed to such a state that, in the case of a honeycomb core the cell walls have "accordioned" or buckled into a solid stack, and no further energy absorption occurs, i.e. the impacting force is transmitted through the absorption system and directly to the user with no attenuation whatsoever.

The energy required to compress an isolation or suspension material is defined as the area beneath a force-deflection plot. This area also determines the maximum energy that can be absorbed by an isolation or suspension system. In FIG. 6 an idealized square-wave force-deflection plot is illustrated. Deflection of the isolation or absorption material is plotted along the horizontal axis, the amount of force transmitted to the body of the user is plotted along the vertical axis. It should be noted that the offset 70 from the vertical axis is only for purposes of illustrating the response of an ideal isolation or absorption system. An idealized square-wave 72 has its desired maximum force plateau set at the maximum force of 80 psi. It will be noted that, in this ideal system, a force of 80 psi is reached virtually instantaneously. That is, the force of 80 psi is encountered with no deflection of the isolation material. The force of 80 psi is maintained for a deflection range of approximately zero to 70 percent until a bottoming-out region 74 is encountered whereupon the impact force is transmitted directly to wearer because the isolation or absorption system has been fully compressed. Increasing the stiffness or thickness of the panel will increase the energy that can be described.

FIG. 7*a* illustrates a force-deflection plot for a representative sample of thermoplastic elastomeric honeycomb material of the present invention. A force-deflection curve 76 for a flexible thermoplastic elastomeric honeycomb panel is shown in comparison with the idealized square-wave response 72 (shown in dashed lines). It will be appreciated that, in a first portion 78, the curve 76 nearly instantaneously ramps up to the maximum desired force level plateau of 80 psi. The curve 76, in a second portion 79, continues to approach the force plateau of 80 psi until the bottoming-out region 74 is reached at roughly the 70% deflection point. It is appreciated that the curve 76 is a close approximation of the idealized square-wave response curve 72 (shown in dashed lines).

FIG. 7*b* illustrates force-deflection curve comparisons for different absorption or isolation systems. Specifically, a coil spring system (curve 80), a closed cell foam system (curve 81), and a thermoplastic elastomeric honeycomb panel system of the present invention (curve 76) are compared to the ideal square-wave response 72. It is quite evident that for a given amount of deflection, the area 82 under the curve 76 is much greater than a corresponding area 83 under the curve 80 representing a linear rate system (i.e. coil spring) or the area 84 under the curve 81 representing a rising rate system (i.e. closed cell foam). Assuming that the honeycomb system has enough area 82 under the curve 76 to absorb the remaining energy of the bullet without bottoming out, the maximum load that will be experienced by the user is 80 psi which, in this example, will not cause blunt trauma. Note that for a rising rate system (i.e. closed cell foam) to achieve the same result, the thickness of the foam must increase in order to absorb the same amount of energy. In a linear ramp system as represented by the curve 80, the thickness required to manage a given amount of energy is nearly twice that of a honeycomb system, i.e. the curve 76, since the area 83 beneath the curve 76 is nearly one-half that of the area 82.

Other energy absorbing systems do not fare as well as honeycomb because they are either too soft or too thin to absorb the remaining bullet energy, or are too rigid to be comfortable to wear. As these systems bottom out they pass energy into the body (or in the case of a ballistics test, into a clay backing material which records the backface deformation).

Figure 8:
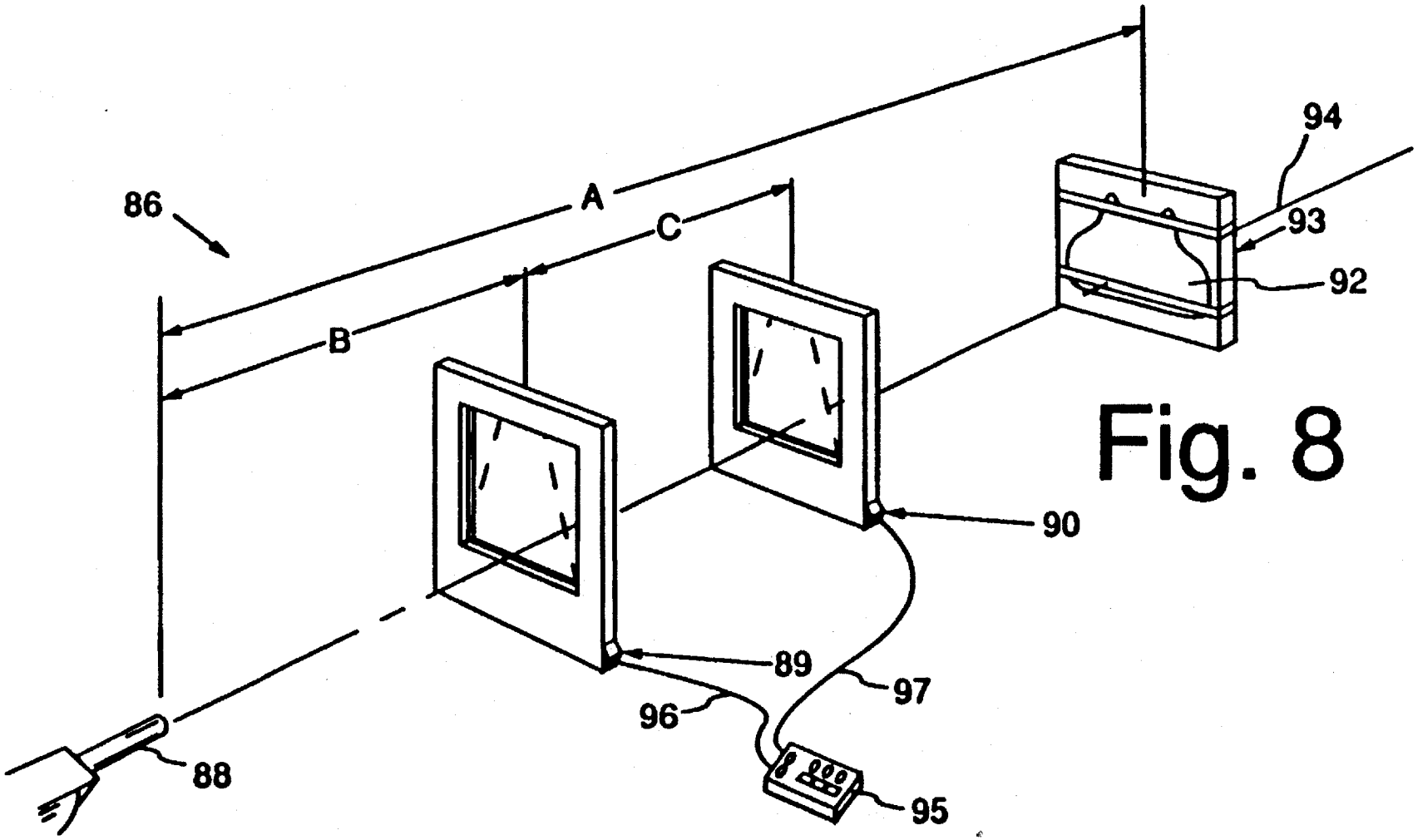
FIG. 8 depicts a schematic illustration depicting a ballistic test setup as specified in the National Institute of Justice (NIJ) Standard 0101.03, entitled "Ballistic Resistance of Police Body Armor"

Four different panel configurations were tested using a ballistic test setup 86 illustrated in FIG. 8. The test setup and procedure is further described in the National Institute of Justice (NIJ) Standard 0101.03 entitled "Ballistic Resistance Police Body Armor" which is hereby incorporated by reference. The ballistic test setup 86 includes a test weapon 88, a start trigger 89, a stop trigger 90 and a test target 92 mounted to a clay backing material 93. The clay material 93 used to back up the target 92, is considered to be a reasonable approximation of the user's body resistance. The test weapon 88 is aimed along a line of sight 94 to the vest target 92. The start trigger is in electrical communication with a chronograph 95 via a wire 96. Similarly, the stop trigger 90 is in electronic communication with the chronograph 95 via a wire 97. The operation of the ballistic test is done in accordance with the procedures as set forth in the NIJ standard 0101.03. The distances A, B, and C, illustrated in FIG. 8 are described in greater detail in the NIJ standard.

Four sample articles were tested for backface signature using the setup 86 illustrated in FIG. 8. Sample article 1 is substantially identical to article 64 (FIG. 4). Each of the layers 24, 60 includes one ply of Spectra® Shield material. The layer 26 includes 50 plies of Spectra® Fabric material. The layer 66 includes a single ply or panel of honeycomb core 30, fabricated from a SEPP material, which is an elastomer polypropylene. The ribbon thickness is 10 mil, the cell size is 0.187 inch, and the core thickness is 0.250 inch. The core is not faced, i.e. bare core, and has perforated cell walls. Sample article 1, therefore, has a total of 53 plies.

Sample article 2 is substantially identical to the article 68 (FIG. 5). Each layer 24, 60 includes one ply of Spectra® Shield material. The layer 26 includes 50 plies of Spectra® Fabric material. The layer 69 includes one ply or panel of honeycomb core 30 made from SU90 material, a urethane having a 90 durometer. The ribbon thickness is 15 mil, the cell size is 0.187 inch, and the core thickness is 0.250 inch. The core is not faced and has non-perforated cell walls. Sample article 2 has a total of 53 plies or panels.

Sample article 3 is generally the same configuration as Sample article 2 except that the layer 26 includes 45 plies of Spectra® Fabric material. Thus, there are a total of 48 plies and panels. Sample article 4 is generally the same configuration as Sample article 1 except that the layer 26 includes 45 plies of Spectra® Fabric material. Thus, there are a total of 48 plies and panels.

The results for backface signature for the four sample articles are shown in Table 1. It is significant, that the typical backface signature, i.e. deformation, when testing any of the sample article configurations is on the order of 23–24 mm. It should be noted that typical foam backed ballistic resistant panels have a deformation of 27–32 mm. Further, the NIJ requires that the deformation for the tested article be less than 44 mm in order to earn a certificate of compliance. The sample articles exhibited deformations 25–30% lower than the results achieved with a typical foam liner and about 55% lower than the certification requirements specified by the NIJ standard. This represents a significant improvement over the prior art ballistic resistant vests.

Figure 9:
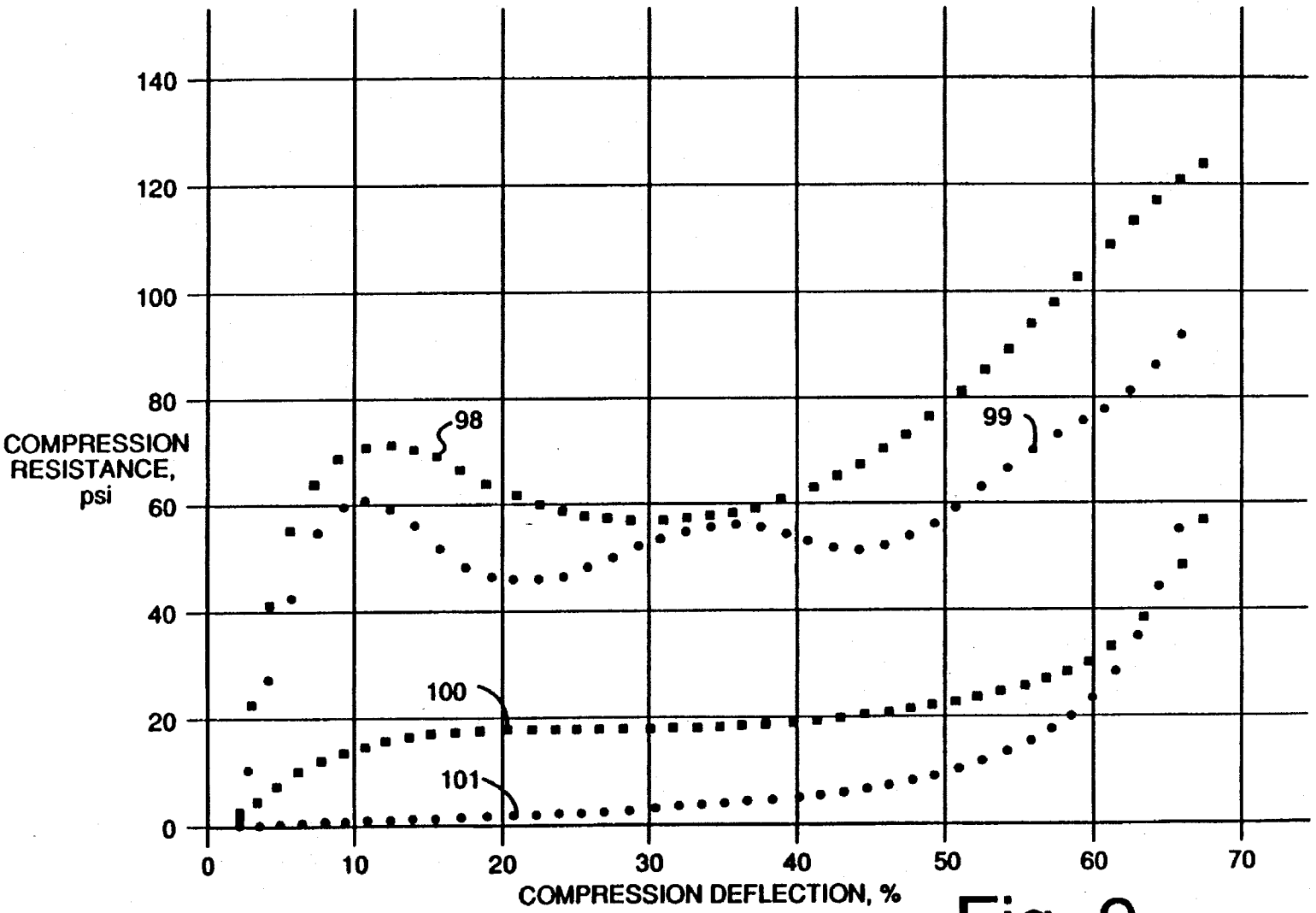
FIG. 9 illustrates several force-deflection characteristic curves comparing the different panel materials that are used in the ballistic resistant articles illustrated in FIG. 3–4.

FIG. 9 illustrates the force-deflection characteristics of SEPP and SU90 thermoplastic elastomeric honeycomb panels. There is little difference in the force-deflection characteristics of the SEPP material used in Sample articles 1 and 4, and the SU90 material used in Sample articles 2 and 3.

Curves 98–101 represent the force-deflection characteristics of two different honeycomb materials obtained during several force-deflection measurement tests. Curves 98 and 100 (i.e. the square symbols) illustrate the SU90 material used in Sample articles 2 and 3, and curves 99 and 101 (i.e. the circle symbols) depict the SEPP material used in Sample articles 1 and 4.

The upper curves 98 and 99 show the resistance to loading exhibited by the SEPP and SU90 materials. The lower curves 100 and 101 illustrate the response of the SEPP and SU90 materials when they are unloaded. That is, the lower curves depict how the materials spring back when the loading is removed. The area bounded between the upper curves and the lower curves for the same material (i.e. curves 98, 100 for SU90 material, and curves 99, 101 for SEPP material) is called a hysteresis loop, and shows the amount of energy absorbed by the specimen during the test. Typically, the test samples were compressed at 35 inches/sec and uncompressed at 2 inches/min. Thus, the curves 98–101 were not obtained at velocities comparable to ballistic projectiles. However the general characteristics should remain the same.

Generally speaking, increasing the ribbon thickness while maintaining a constant cell size does make the honeycomb panel stiffer in compression. However, the SU90 material (sample articles 2, 3) is a urethane material, whereas the SEPP material (sample articles 1, 4) is an elastomeric polypropylene, which has a higher flexural modulus and is stiffer than urethane. Consequently, the SEPP material does not require the same ribbon thickness to achieve the same compressive resistance. Although the force-deflection performance is similar, the SEPP material is considerably lighter, and consequently is favored for use as the core material in the preferred embodiment (FIG. 2). In addition, the SEPP material has more inherent hysteresis, i.e. greater damping, which means that it internally absorbs, or dissipates, more energy when struck. The SU90 urethane is more resilient, and will take more repeated impacts, but that is not the most important characteristic for this particular application.

Although preferred and alternate embodiments and applications of the present invention have been disclosed above, it will be appreciated that numerous applications, alterations and modifications thereof will no doubt become apparent to those skilled in the art after having read the above disclosures. It is therefore intended that the following claims may be interpreted as covering all such applications, alterations and modifications as fall within the true spirit and scope of the invention.

TABLE 1

BALLISTICS TEST RESULTS

| Sample | Trials: Backface Signature, i.e. deformation (mm) | | | | | |
|---|---|---|---|---|---|---|
| Article | 1 | 2 | 3 | 4 | 5 | 6 |
| 1 | 23 | 21 | 24 | 17 | 18 | 18 |
| 2 | 22 | 21 | 21 | 14 | 13 | 23 |
| 3 | 22 | 24 | 23 | 20 | 20 | 22 |
| 4 | 21 | 21 | 21 | 20 | 21 | 24 |

What is claimed is:

1. A flexible ballistic resistant article to protect a user from a high speed projectile, comprising:

a) an outer layer for stopping the forward motion of said projectile and including at least one ply having a plurality of fibers;

b) an inner layer for controlling force transmission to said user, said inner layer being disposed between and adjacent to each of said user and said outer layer, and including (i) a honeycomb core formed of undulated strips of resilient thermoplastic material, thermal compression bonded together to form cell walls defining a plurality of contiguous regularly shaped cells, said core having a first face formed by a first extremity of said cell walls and a second face formed by a second extremity of said cell walls;

(ii) at least one facing sheet of resilient thermoplastic material being fixably engaged to at least one of said first or second faces to maintain said core in an expanded configuration so that it can anisotropically flex to stabilize and spread the load when said article is impacted by the projectile;

c) a cover for encasing each of said inner and said outer layers; and d) a user attachment means for being engaged to said cover for removably attaching said cover to said user.

2. A flexible ballistic resistant article as recited in claim 1, wherein at least one of said first and second faces of said core is non-planar.

3. A flexible ballistic resistant article as recited in claim 2, wherein said core includes perforations formed in at least one of said cells walls.

4. A flexible ballistic resistant article as recited in claim 3, wherein said facing sheet of resilient thermoplastic material is thermal compression bonded to said first face of said core.

5. A flexible ballistic resistant article as recited in claim 1, wherein said outer layer includes:

a) a first material layer having at least one ply of unidirectional layers of high strength fibers; and b) a second material layer having a plurality of interwoven fibers of high strength.

6. A flexible ballistic resistant article as recited in claim 5, wherein at least one of said first and second faces of said core is non-planar.

7. A flexible ballistic resistant article as recited in claim 6, wherein said core includes perforations formed in at least one of said cells walls.

8. A flexible ballistic resistant article as recited in claim 7, wherein said facing sheet of resilient thermoplastic material is thermal compression bonded to said first face of said core.

9. A flexible ballistic resistant article as recited in claim 1, further including:

a) an inner material layer having at least one ply of high strength fibers, and being disposed adjacent to and between each of said user and said inner layer.

10. A flexible ballistic resistant article as recited in claim 9, wherein at least one of said first and second faces of said core is non-planar.

11. A flexible ballistic resistant article as recited in claim 10, wherein said core includes perforations formed in at least one of said cells walls.

12. A flexible ballistic resistant article as recited in claim 11, wherein said facing sheet of resilient thermoplastic material is thermal compression bonded to said first face.

* * * * *